United States Patent [19]

Alder et al.

[11] 4,392,925

[45] Jul. 12, 1983

[54] ELECTRODE ARRANGEMENT IN A CELL FOR MANUFACTURE OF ALUMINUM FROM MOLTEN SALTS

[75] Inventors: Hanspeter Alder, Flurlingen; Eugen Schalch, Neuhausen, both of Switzerland

[73] Assignee: Swiss Aluminium Ltd., Chippis, Switzerland

[21] Appl. No.: 257,891

[22] Filed: Apr. 27, 1981

[30] Foreign Application Priority Data

May 14, 1980 [CH] Switzerland ..... 3873/80

[51] Int. Cl.[3] ..... C25C 3/08

[52] U.S. Cl. ..... 204/67; 204/245; 204/294

[58] Field of Search ..... 204/67, 243 R–247, 204/291, 294

[56] References Cited

U.S. PATENT DOCUMENTS

| | | | |
|---|---|---|---|
| 3,502,553 | 3/1970 | Gruber | 204/67 |
| 3,554,893 | 1/1971 | De Varda | 204/245 X |
| 3,960,678 | 6/1976 | Alder | 204/291 X |
| 3,960,696 | 6/1976 | Wittner | 204/67 X |
| 4,177,128 | 12/1979 | Rahn | 204/243 R |
| 4,243,502 | 1/1981 | Kugler | 204/294 X |
| 4,297,180 | 10/1981 | Foster, Jr. | 204/67 |

*Primary Examiner*—Donald R. Valentine

*Attorney, Agent, or Firm*—Bachman and LaPointe

[57] ABSTRACT

The durability of oxide-ceramic anodes can be increased, if the aluminum surface which lies opposite the active anode surface and is in direct contact with the molten electrolyte, is smaller than the active anode surface. The separated aluminum is collected on the floor of the carbon lining and is sub-divided by an insulating material into pools, which are connected together by means of tubes or channels. The total of all the aluminum surfaces exposed to the melt amounts to 10–90% of the active anode surface.

28 Claims, 5 Drawing Figures

ELECTRODE ARRANGEMENT IN A CELL FOR MANUFACTURE OF ALUMINUM FROM MOLTEN SALTS

BACKGROUND OF THE INVENTION

The present invention relates to an electrode arrangement in a cell for manufacture of aluminum from molten salts with dimensionally stable anodes and a liquid metal product cathode.

The currently employed Hall-Héroult process for extracting aluminum from alumina dissolved in cryolite takes place at 940°–1000° C., while usually the electrolysis is carried out between a horizontal anode and a liquid aluminum cathode parallel to it. The oxygen separated anodically reacts with the carbon of the anode to form carbon dioxide, so that the carbon burns away. To the same extent as the linear burning away of the anode occurs, at the cathode the aluminum metal pad builds up, so that, for a suitable cell geometry, the interpolar distance remains practically constant. After the tapping of the liquid aluminum, the interpolar distance must be re-adjusted by lowering of the anodes, and furthermore consumed carbon anode blocks must be replaced at regular intervals of time. For manufacture of these anode blocks a special factory is necessary, namely the carbon plant.

Proposals have therefore been made to replace the consumable carbon anodes by dimensionally stable anodes of oxide-ceramic material, which show a whole series of advantages:

simplification of service of the cell, reduction and improved collection of the cell waste gases, independence of variations of price and quality of petroleum coke, lower total energy consumption of the process.

These factors should result in reduced prime cost of metal.

For dimensionally stable anodes of oxide-ceramic material, as are known for example from British Pat. No. 1,433,075, whole classes of material have been described in further publications, for example spinel structures in German OS No. 24 46 314 and in Japanese published pending application 52-140411 (1977).

The multiplicity of the proposed metal oxide systems indicates that heretofore no ideal material has yet been found, which in itself satisfies the many and partly contradictory requirements of the cryolite electrolysis, while being economical.

The inventors have therefore formulated the task to produce an electrode arrangement for manufacture of aluminum from molten salts with dimensionally stable anodes, in which the stability of the anode material is further improved by special means.

SUMMARY OF THE INVENTION

According to the present invention the problem is solved in that the aluminum surface which lies opposite the active anode surface and is in direct contact with the molten electrolyte, is smaller than this active anode surface, at the carbon bottom there is formed a collecting device for the liquid metal, sub-divided by insulating material, the pools of liquid aluminum of all the sub-divisions are connected together in communication by tubes or channels, and the total of all the aluminum surfaces exposed to the melt amounts to 10–90% of the active anode surface.

The researches underlying the invention have surprisingly shown that, in the electrolysis of aluminum oxide dissolved in a cryolite melt, the ratio of the aluminum surface in direct contact with the molten electrolyte, lying in the area of projection of the anodes, to the active anode surface has a very significant effect on the corrosion of the oxide-ceramic anodes, and even at relatively large inter-polar distances. By reducing the cathode surface, which preferably lies between 20 and 50% relative to the active anode surface, the cathodic current density is correspondingly increased, which leads to a greater voltage drop across the interpolar distance and in the cathode. Thus the reduced anode corrosion has to be balanced against an increased consumption of electrical energy.

In establishing the optimum ratio of the aluminum surface in contact with the molten electrolyte to the active anode surface, numerous further parameters must therefore be taken into account, e.g. local cost of electricity, manufacturing costs of the oxide-ceramic anodes, and requirements concerning the quality of the metal manufactured.

In conventional electrolytic cells the aluminum surface in contact with the electrolyte is the upper boundary of a layer of aluminum several centimeters deep.

The aluminum surface to be considered for the ratio according to the invention can however be at least partly constituted by a metal film deposited on a wettable solid cathode body, which flows together in a subdivision on the cell floor and into a pool.

These wettable solid cathode bodies must however not only have good electrical conductivity, but be stable under the operating conditions, with respect to the cryolite melt, and also be wetted by the liquid aluminum (film formation). As materials for the solid cathode bodies refractory hard metals are considered, e.g. carbides, borides, silicides and nitrides of the transition elements in Groups IVa, Va and VIa of the Periodic Table of Elements. These carbides, borides, silicides and nitrides can be combined with the boride, nitride or carbide of aluminum and/or the nitride of boron. Preferably, however, titanium diboride is introduced, in some cases in combination with boron nitride.

The aluminum collected in the form of pools is suitably removed from the bath convection, by placing it deeper and further away from the active anode surface, the distance of the active anode surface to the aluminum level should preferably amount to at least 1.5 times the interpolar distance.

In contrast to the wettable solid cathode bodies described above, which carry the produced liquid aluminum film, and are arranged horizontally or slightly inclined, the cathodes can also be arranged vertically or nearly vertically. Then, parallel rows of anode and cathode elements carry—with the exception of the cathodes or anodes at the end—the current on both sides. In this case anode and cathode elements must be arranged alternately. Below the anodes there is the insulating material limiting the surface of the collected, produced aluminum; the lower part of the cathodes dips into the aluminum pools formed by this insulating material.

In the retrofitting of existing Hall-Heroult cells with consumable carbon anodes to dimensionally stable oxide-ceramic anodes, the geometrical surface of the aluminum forming the cathodes is greater than the active anode surface. This ratio, which is unfavorable with reference to the invention, is further worsened in that, under the influence of the magnetic field exerted by the electrolysis current, the liquid metal heaves up and a wave motion is produced, which affects the ratio of the effective cathode surface to the anode surface in a negative way, since the metal surface in direct contact with the electrolyte is increased. The ratio of 10–90% required according to the invention is obtained in that the lowermost part of the side crust, the so-called "ledge", is drawn under the anodes and/or the liquid aluminum is sub-divided by a stable insulating material. In this way even with retrofitted cells the anode corrosion can be significantly lowered.

BRIEF DESCRIPTION OF THE DRAWING

The invention will be explained more closely with reference to various embodiments. The schematic cross sections of the drawing show electrode arrangements in a cell for manufacture of aluminum from molten electrolyte.

DETAILED DESCRIPTION

Figure 1:
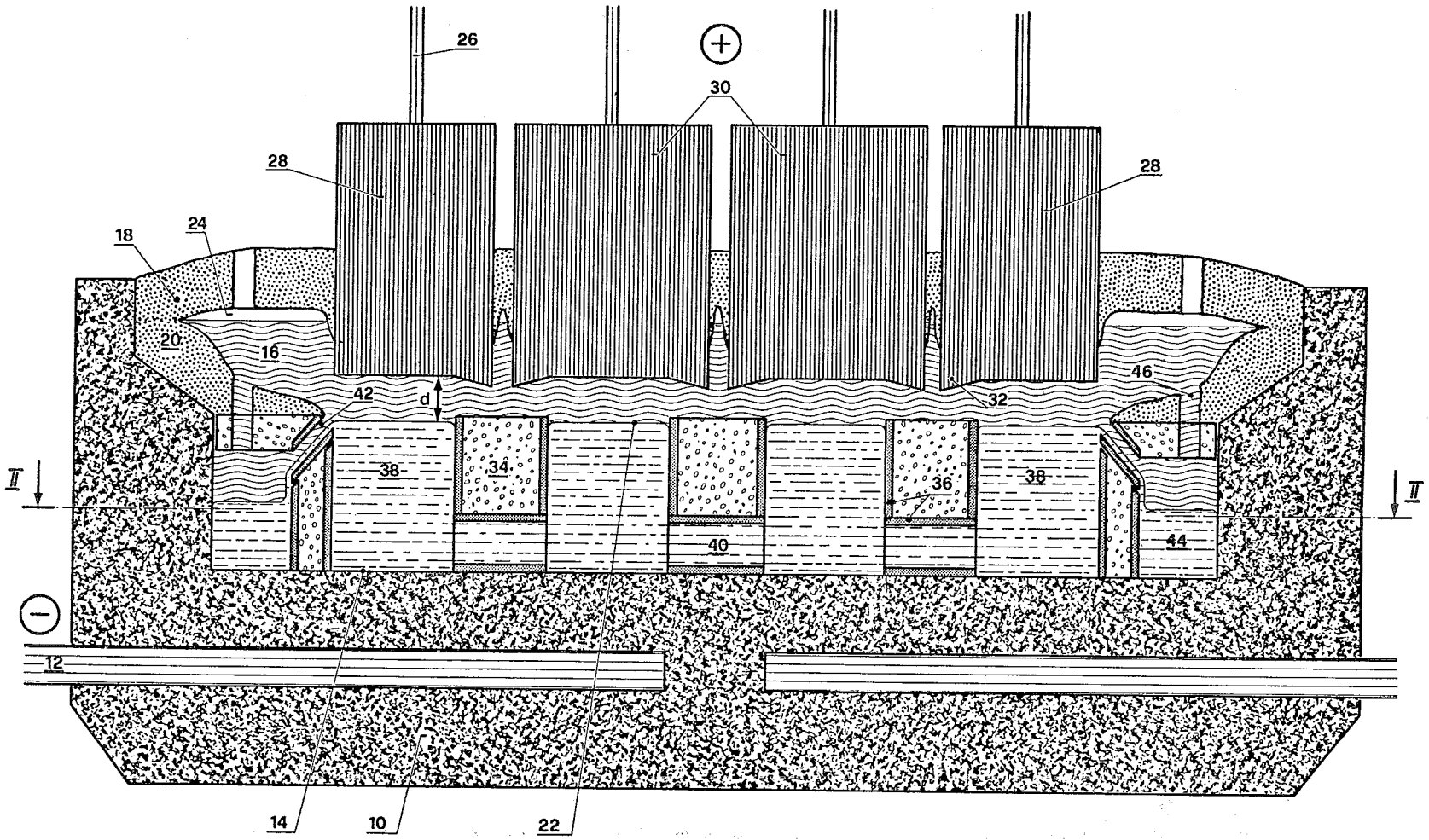
FIG. 1: A vertical section of an arrangement with oxide-ceramic anode blocks and an aluminum layer sub-divided by insulating material.
Figure 3:
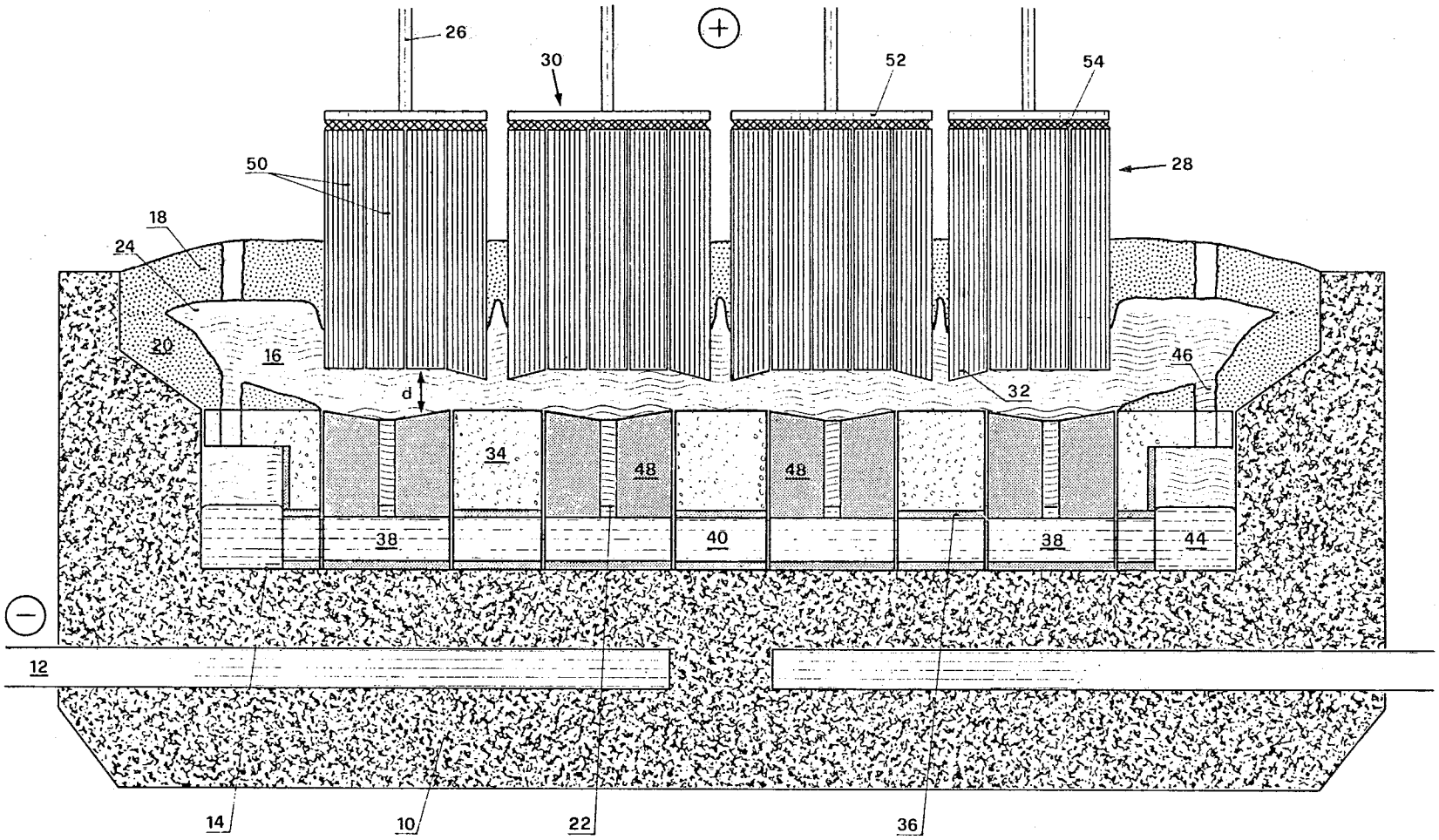
FIG. 3: A vertical section of an arrangement with oxide-ceramic bundle anodes and wettable solid cathode bodies.
Figure 4:
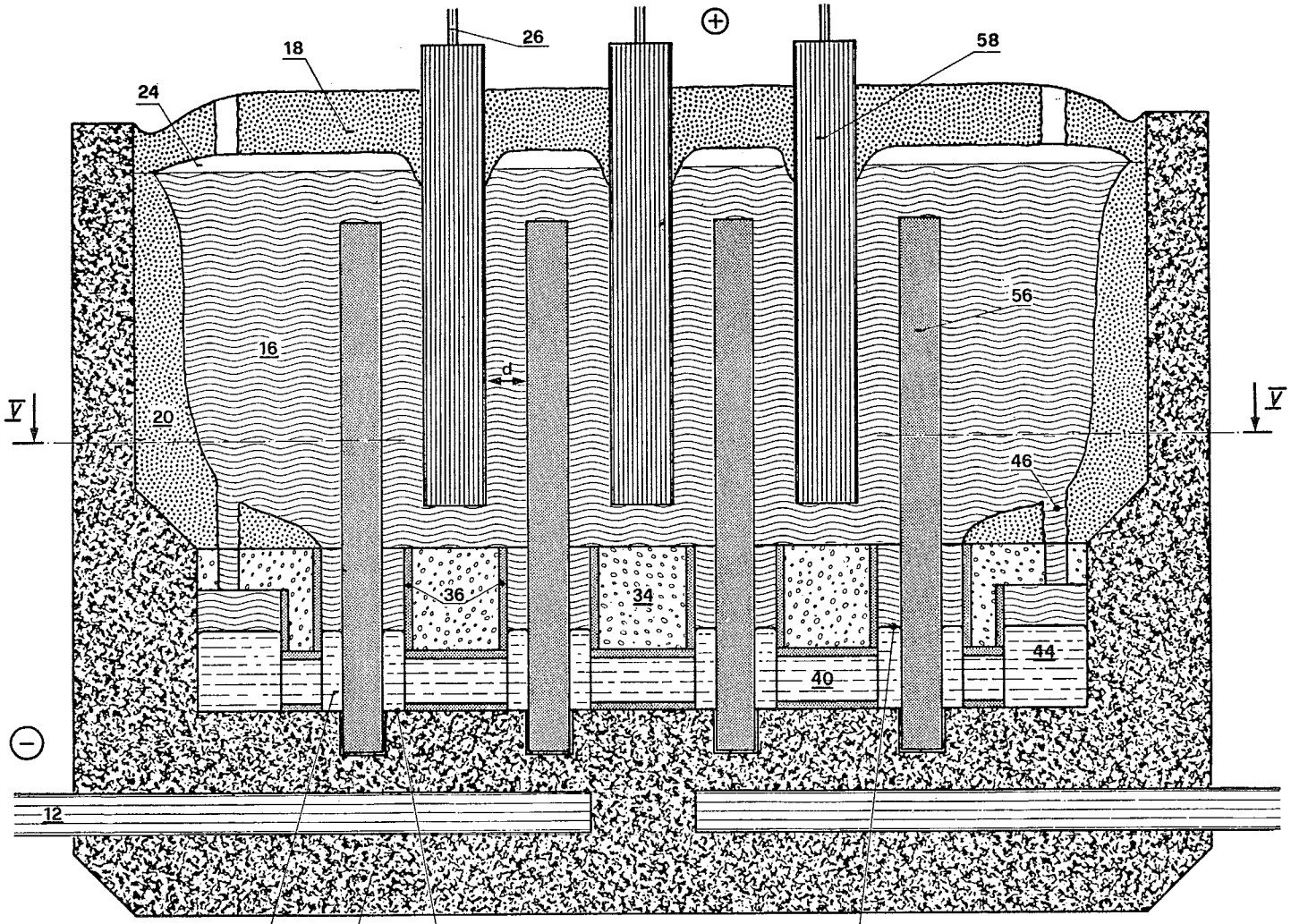
FIG. 4: A vertical section of a device with alternate cathodes and anodes.

The electrolytic cells include a carbon bottom 10, which is embedded in a steel container, not shown, lined with insulating material. From both longitudinal sides of the cell, cathode bars 12 extend into the carbon block 10 near the center thereof (FIGS. 1, 3 and 4). On the floor 14 of the trough-shaped carbon bottom 10 there lies a layer, several centimeters thick, of liquid produced aluminum. In direct contact with the surface 22 of the liquid aluminum layer 13 is the molten electrolyte 16, which contains dissolved aluminum oxide. The uppermost layer of the electrolyte 16 is solidified into a rigid crust 18. In the peripheral areas of the cell there is also a rigid so-called "ledge" 20. Between the liquid electrolyte 16 and the solidified crust 18 an air gap 24 is formed. For improvement of the heat insulation of the cell, in general a layer of aluminum oxide (not shown) is dumped on top of the solidified crust 18, which is successively pushed into the bath during cell servicing.

Anodes 28, 30, 50, 58, carried by anode holders 26, dip from above into the electrolyte, at an interpolar distance d from the cathode.

Figure 2:
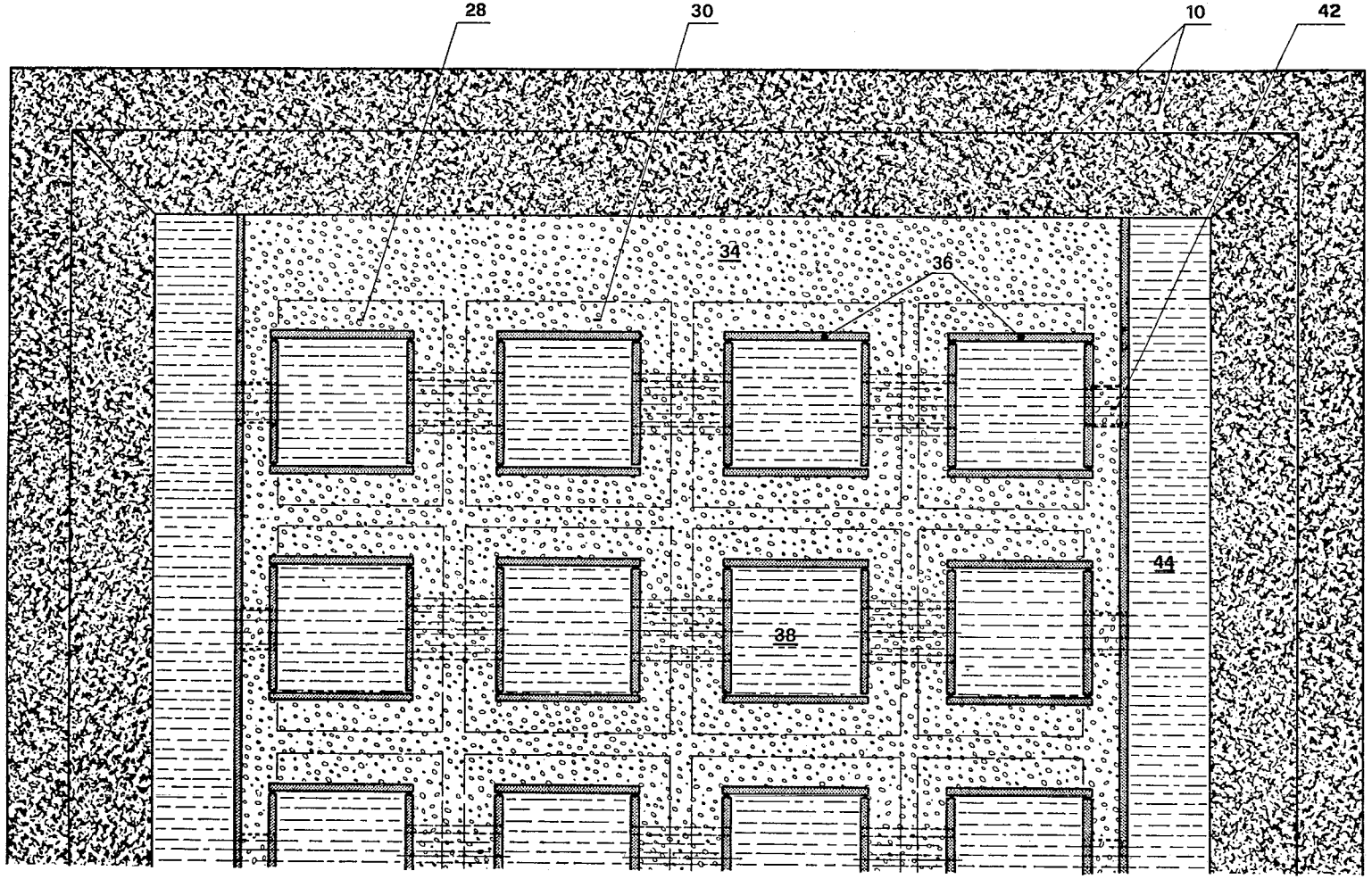
FIG. 2: A horizontal section II—II through FIG. 1.

In FIGS. 1, 2 and also 3 the ratio of the aluminum surface in direct contact with the electrolyte, which is identical with the cathode surface, is less than 50% relative to the active anode surface. Because of the lateral ledge of solidified cryolite material, the anodes 28 at the end are made smaller than the central anodes 30, preferably by 15 to 30%. The edge zone 32 of the active anode surface above the insulating material 34 is bevelled off concavely.

The zone of transition of the anodes from the surrounding atmosphere 24 into the electrolyte is, as described in the British Pat. No. 1 433 075, suitably protected by a crust of solidified electrolyte material.

The liquid aluminum is sub-divided by insulating materials 34, 36 into individual pools 38, which communicate through pipes or channels 40, or open into a collecting tank 44 via an overflow 42 (FIG. 1). The aluminum can be periodically tapped through a suction hole 46 by means of a suction pipe dipped into the collecting tank 44.

The aluminum pools of circular or square boundary 38 are in contact with the floor 14 of the carbon bottom 10, so that the transition resistance for the electric current is smaller. At the sides the pools 38, the overflow 42 and the collecting tank 44 are lined by plates of densely sintered material. This material is either an insulator on an oxide basis, for example aluminum oxide or magnesium oxide, a refractory nitride, such as boron nitride or silicon nitride, or an electrical conductor of refractory hard metal, for example titanium diboride. It is however necessary that the lining 36 is on the one hand dense and on the other hand withstands the conditions of electrolysis. Also the pipes 40 which provide a communicating balance between the individual aluminum pools 38 are lined with plates of the same material.

The insulating material 34 built in between the insulating plates 36 need not be dense, and is based preferably on oxides, for example aluminum oxide or magnesium oxide, or on nitrides such as boron nitride or silicon nitride. The insulating materials 34, 36 can additionally be protected, by keeping their temperature below the solidus line of the cryolite melt, so that solidified melt forms a protective crust. This temperature drop can be produced either by incorporation of a cooling system, or be effected by the loss of heat through the cell bottom.

Likewise in the electrode arrangement shown in FIG. 3 for a cell with molten electrolyte, the ratio of the aluminum surface in direct contact with the molten electrolyte lies below 50% relative to the active anode surface. Here wettable solid cathode bodies of material of good electrical conductivity are introduced, which are wetted by a film of produced aluminum. The surface of the solid cathode bodies facing towards the anodes is inclined slightly inwards like a funnel, so that the aluminum film flows towards the center of the cathode body, in which a central bore is made, and arrives in an aluminum pool 38. The aluminum pools are connected by the pipes 40 communicating with one another and with a collecting tank 44. The shape of the solid cathode body 48, for example of titanium diboride, is not significant to the invention. It can, as shown in FIG. 3, be formed as a complete cylinder, with a funnel-shaped recess, also as a pipe, bundle of pipes, or plate.

The interval between the fixed cathode bodies is filled in with the insulating material 34, 36 described in FIGS. 1 and 2. Moreover the anodes 28, 30 dipping from above into the molten electrolyte correspond in principle to those employed in FIGS. 1 and 2. However, instead of a homogeneous block, there is introduced as an anode body a bundle of rod-shaped elements, as described in British Patent Application No. 80 40 442. Each anode bundle 28, 30 is provided with a current conductor or anode bar 26, and has a distribution plate 52 with a contact 54.

Figure 5:
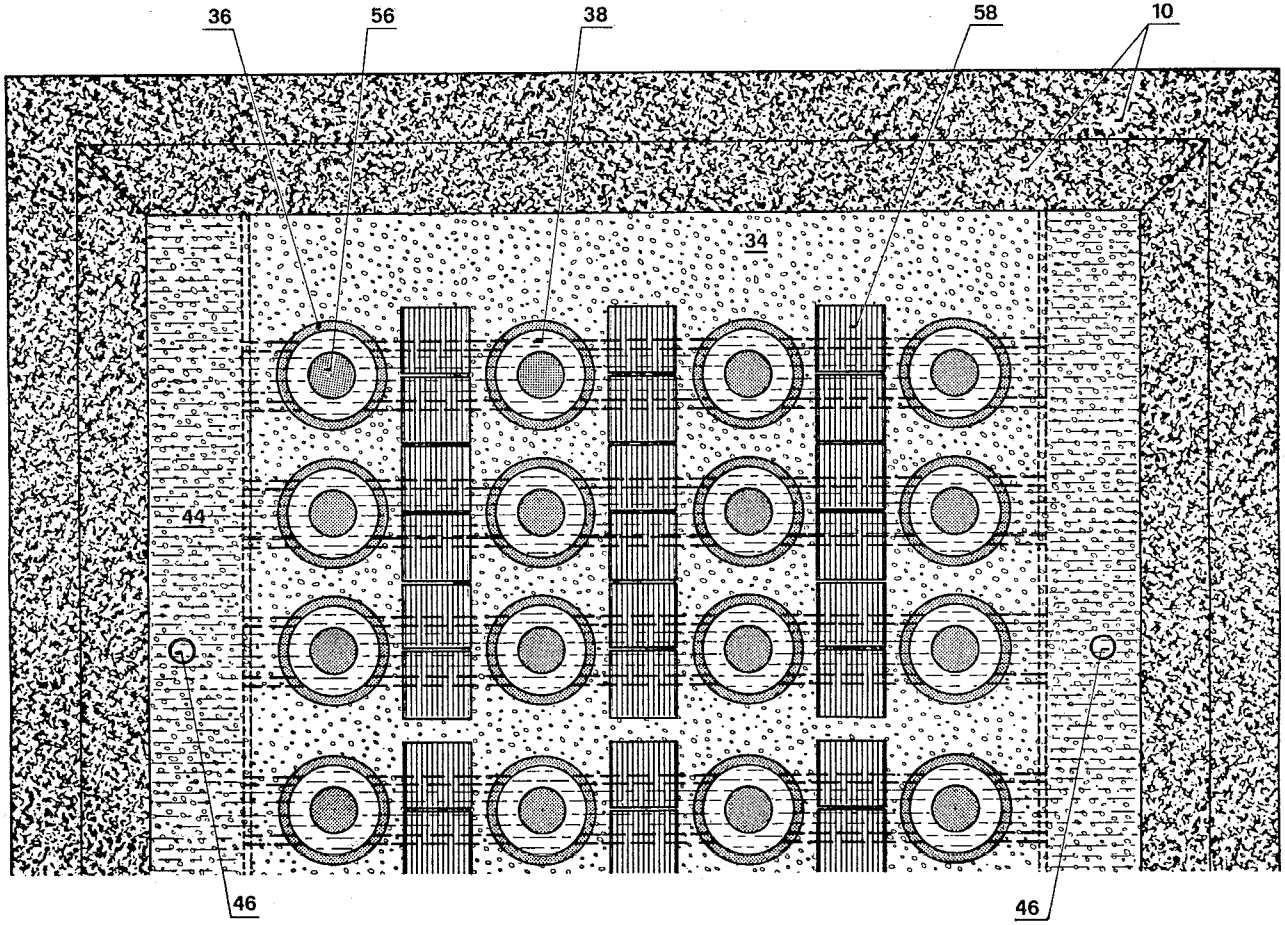
FIG. 5: A horizontal section V—V through FIG. 4.

The cathodes 56 of FIGS. 4 and 5 are manufactured as round bars of refractory hard metal, which, with the exception of the two end elements (FIG. 4) are carrying on both sides electric current. These elements, which consist of one of the materials described above, extend out of the anchorage in the floor of the carbon lining 10 far into the melt 16. The aluminum produced during the electrolysis flows along the cathode as a film, and is collected in an aluminum pool 38, arranged on the floor 14 of the cell, which communicates via the pipes 40 with an aluminum collection tank 44.

The cathode elements 56 instead of being made as cylinders can also be made as prisms with square, rectangular, or hexagonal cross section, or as tubes.

The anodes 58 can be assembled into rows in the same or different geometrical forms as the cathodes, these anode rows carry current on both sides. In FIGS. 4 and 5, opposite each two anodes there is a cathode of significantly smaller diameter, so that the surface ratio of the cathode surface in direct contact with the electrolyte lies again significantly below 50% with respect to the active anode surface.

From the experimental results contained in the following Table it can be seen how the reduction of the aluminum surface K in direct contact with a usual molten electrolyte, compared with the active anode surface A, acts upon the corrosion of an anode consisting of $SnO_2$ with 2% by weight CuO and 1% by weight $Sb_2O_3$ at 970° C.:

TABLE

| K in % of A | Anode Corrosion (cm/h) |
|---|---|
| 113 | $14 \cdot 10^{-4}$ |
| 70 | $7 \cdot 10^{-4}$ |
| 23 | $4 \cdot 10^{-4}$ |

When the aluminum surface K is large in relation to the active anode surface A, the oxide-ceramic anode corrodes more strongly than with a smaller ratio K:A. However, it should be noted at the same time that the cathode current density increases to the same extent as K is reduced, from 1.05 A/cm$^2$ through 1.70 A/cm$^2$ to 5.20 A/cm$^2$ in the tests mentioned in the Table. The constant anode current density amounts to 1.19 A/cm$^2$. It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An electrolytic cell for use in the production of aluminum comprising:
   - a pot having a floor and sidewalls;
   - a melt of liquid aluminum within said pot on said floor;
   - a molten electrolyte within said pot on said melt of liquid aluminum;
   - at least one anode within said pot projecting into said molten electrolyte such that the top surface of said melt of liquid aluminum is a distance d from the active bottom surface of said at least one anode; and
   - insulating means within said pot in said melt of liquid aluminum for reducing the surface area of said melt of liquid aluminum in direct contact with said molten electrolyte such that the total surface area of said melt of liquid aluminum exposed to said molten electrolyte is from about 10–90% the active surface area of said at least one anode.

2. An electrolytic cell according to claim 1 wherein said insulating means for reducing the surface area of said melt of liquid aluminum comprises a plurality of insulated members.

3. An electrolytic cell according to claim 2 wherein at least one of said plurality of insulated members is provided with a passage for communicating said melt of liquid aluminum.

4. An electrolytic cell according to claim 2 wherein a plurality of anodes project into said molten electrolyte.

5. An electrolytic cell according to claim 4 wherein the edges of the active surface area of the anodes lie above said insulated members.

6. An electrolytic cell according to claim 5 wherein said edges are bevelled concavely.

7. An electrolytic cell according to claim 1 wherein said at least one anode is a dimensionally stable anode.

8. An electrolytic cell according to claim 1 wherein said total surface area of said melt of liquid aluminum exposed to said molten electrolyte is from about 20–50% the active surface area of said at least one anode.

9. An electrolytic cell according to claim 1 wherein at least a portion of said total surface area of said melt of liquid aluminum comprises a wettable cathode body having a film of aluminum deposited thereon.

10. An electrolytic cell according to claim 9 wherein said wettable cathode body is provided with a passage for communicating said film of aluminum with said melt of liquid aluminum collected on said floor of said pot.

11. An electrolytic cell according to claim 10 wherein the surface of said melt of liquid aluminum collected on said floor of said pot is at a distance equal to at least 1.5 d from the active surface of said at least one anode.

12. An electrolytic cell according to claim 1 wherein a plurality of anodes project into said molten electrolyte.

13. An electrolytic cell according to claim 12 wherein the anodes proximate to said sidewalls of said pot are from about 15–30% narrower than the other anodes.

14. An electrolytic cell according to claim 12 wherein a plurality of cathode elements are provided within said pot and are arranged alternately with and parallel to said plurality of anodes.

15. An electrolytic cell according to claim 14 wherein said anodes and said cathodes not proximate to said sidewalls of said pot carry current on both sides.

16. An electrolytic cell according to claim 14 wherein said anodes and said cathodes are arranged vertically.

17. An electrolytic cell according to claim 12 wherein said anodes are plate-shaped.

18. An electrolytic cell according to claim 1 wherein said melt of liquid aluminum is in fluid communication with at least one collection tank.

19. A method of improving the stability of an anode used in the electrolysis of aluminum comprising:
   - providing an electrolytic cell comprising a pot having a floor and sidewalls, a melt of liquid aluminum on said floor and molten electrolyte on said melt of liquid aluminum;
   - positioning at least one anode within said pot in said molten electrolyte such that the active surface of said at least one anode is a distance d from the top surface of said melt of liquid aluminum; and
   - providing insulating means in said melt of liquid aluminum for reducing the surface area of said melt of liquid aluminum in direct contact with said molten electrolyte such that the total surface area of said melt of liquid aluminum exposed to said molten electrolyte is from about 10–90% the active surface area of said at least one anode.

20. A method according to claim 19 including providing a plurality of insulated members for reducing said surface area of said melt of liquid aluminum.

21. A method according to claim 20 including providing a passage in at least one of said insulated members for communicating said melt of liquid aluminum.

22. A method according to claim 19 further including providing a wettable cathode body in said melt of liquid aluminum having a film of aluminum deposited thereon.

23. A method according to claim 22 including providing a passage in said wettable carbon body for communicating said film of aluminum with said melt of liquid aluminum collected on said floor of said pot.

24. A method according to claim 23 including positioning said melt of liquid aluminum collected on said floor of said pot such that the surface of said melt of said liquid aluminum is at a distance equal to at least 1.5 d from the active surface of said at least one anode.

25. A method according to claim 19 including providing a plurality of anodes.

26. A method according to claim 25 including providing a plurality of cathode elements arranged alternately with and parallel to said plurality of anodes.

27. A method according to claim 26 including arranging said cathodes and said anodes vertically.

28. A method according to claim 19 including providing at least one collection tank and communicating said melt of liquid aluminum with said at least one collection tank.

* * * * *